US007296659B2

(12) United States Patent
Carlsen

(10) Patent No.: US 7,296,659 B2
(45) Date of Patent: Nov. 20, 2007

(54) STAIRCASE LIFT AND A GUIDE RAIL FOR SUCH A LIFT

(75) Inventor: Borge Carlsen, Frederikshavn (DK)

(73) Assignee: BC Lift A/S, Frederikshaven (DK)

( * ) Notice: Subject to any disclaimer, the term of this patent is extended or adjusted under 35 U.S.C. 154(b) by 0 days.

(21) Appl. No.: 10/531,261

(22) PCT Filed: Oct. 16, 2003

(86) PCT No.: PCT/DK03/00704

§ 371 (c)(1),
(2), (4) Date: Apr. 13, 2005

(87) PCT Pub. No.: WO2004/037703

PCT Pub. Date: May 6, 2004

(65) Prior Publication Data

US 2006/0117984 A1 Jun. 8, 2006

(30) Foreign Application Priority Data

Oct. 22, 2002 (EP) ..... 02079401

(51) Int. Cl.
*B66B 9/08* (2006.01)

(52) U.S. Cl. ..... 187/201

(58) Field of Classification Search ..... 187/200, 187/201, 202

See application file for complete search history.

(56) References Cited

U.S. PATENT DOCUMENTS 4,627,517 A * 12/1986 Bor ..... 187/201
4,671,183 A * 6/1987 Fujita et al. ..... 104/93
4,754,849 A * 7/1988 Ando ..... 187/409
5,066,834 A 11/1991 Richter
5,709,154 A 1/1998 Schott
5,967,265 A 10/1999 Bruno et al.
6,098,342 A * 8/2000 Bischof et al. ..... 49/409
6,155,382 A 12/2000 Duijnstee
6,233,878 B1 * 5/2001 Krahenbuhl et al. ..... 52/64
6,434,905 B1 * 8/2002 Sprague ..... 52/474

FOREIGN PATENT DOCUMENTS

DE 31 03 162 A1 8/1982
EP 0 033 295 A2 8/1981
EP 1 053 968 A2 11/2000
EP 1 236 671 A * 9/2002
WO WO 95/29867 11/1995

* cited by examiner

*Primary Examiner*—Thomas J. Brahan
(74) *Attorney, Agent, or Firm*—Jacobson Holman PLLC

(57) ABSTRACT

The invention concerns a staircase lift for transporting a disabled person between floors, including at least one guide rail extending substantially parallelly to a stairway, a moveable carrier frame suspended from the guide rail means including carrier support means, and drive means of a rack and pinion type drive for displacement of the carrier frame along the guide rail, in which the vertically disposed pinion engaging the rack is provided on the lower side of the guide rail, wherein the at least one guide rail includes internal support surfaces which may be engaged by the carrier support means. Hereby, a satisfactory solution is provided making a side rail guided staircase lift suitable for running along a straight as well as a curved track in a stabile and smooth manner while also offering a comfortable and smooth ride in a dignifying way for the disabled persons using the lift.

15 Claims, 14 Drawing Sheets

STAIRCASE LIFT AND A GUIDE RAIL FOR SUCH A LIFT

This is a nationalization of PCT/DK03/000704 filed Oct. 16, 2003 and published in English.

The present invention relates to a staircase lift for transporting a disabled person between floors, including at least one guide rail extending substantially parallelly to a stairway, a moveable carrier frame suspended from the guide rail means including carrier support means, and drive means of a rack and pinion type drive for displacement of the carrier fame along the guide rail, in which the vertically disposed pinion engaging the rack is provided on the lower side of the guide rail.

Staircase lifts of this kind are used to carry disabled persons in wheelchairs or elderly people between floors by means of a stairway. The staircase lift can be mounted on the sidewall or columns of stairways used both indoors and outdoors. The staircase lift includes a moveable frame displaced along a fixedly mounted guide rail on the side of the stairway. This type of staircase lift is driven by a rack and pinion drive whereby relatively steep staircases and a relatively heavy weight may be displaced in the lift. Moreover, a second support rail is provided for stability of the carrier frame during movement of the lift. Depending on the requirements and the actual room in the staircase, two kinds of staircase lifts are used; a so-called platform lift where the carrier frame is provided with drive means and a platform for a wheelchair, and where the platform may be folded up when not in use; or a so-called seat lift where the frame is provided with a foldable seat whereby a chair is provided and accordingly a seating facility for the person to be transported on the lift. By hanging the lift from guide rails on the side of the stairway, the entire staircase lift takes up only a small amount of space on the stairway. This is important, as access to the staircase may not be blocked.

In a staircase with a varying slope and/or curves, it is important to keep the carrier frame vertical in order to ensure safe and comfortable transport in the lift. Examples of staircase lifts with such solutions are known from e.g. WO95/29867 and EP-A-1 053 968. Although these solutions overcome the problem of keeping the frame in a vertical position during changes in the slope, the pinion is displaced in the engagement with the rack if the guide rail is curved. This means that these known staircase lifts are only suitable for straight stairways, as the risk of damaging the drive mechanism when entering a curved section of the stairway is too high which results in an unacceptable level of safety. The drive mechanism in a staircase lift is loaded with the entire weight of the platform, which means that even slight displacements may have devastating effects.

In U.S. Pat. No. 6,155,382 a running gear for a rail-guided seat is known. The seat lift is typically lighter in structure, which means that the drive mechanism can be kept relatively compact in dimensions. In this solution, the pinion is positioned in a plane parallel to that of the slope of the staircase and the seat is mounted on a bridge assembly with two cardan suspensions. Hereby, the problem of curvature in the vertical plane is overcome, as the guide rail bends in the same plane as that of the pinion. However, this solution only works as long as the rack faces towards the staircase. This means that the fixed structure of the lift, i.e. the guide rail system, takes up a lot of space and has a rough and greasy surface pointing towards the staircase whereby pieces of clothing on persons transported in the lift or other people walking on the staircase may be caught or otherwise damaged, e.g. due to oil or grease on the track or even on the steps of the stairway.

Moreover, by the known staircase lifts both lifts with a straight run or curved run, dirt is deposited on the rollers and on the guide rails. This results in a considerable wear on the surface of the guide rail as well as the rollers. Another drawback is that a dirty guide rail is not very attractive to use as a banister.

It is an object of the invention to provide a staircase lift with a smooth and clean surface structure by which the risk of damaging the clothing or otherwise discomforting the users of the staircase in which the lift is present. Another object is to provide an improved staircase lift of the initially mentioned kind, which is suitable for running along a curved track in a comfortable, safe, and reliable manner and which does not take up an unacceptable amount of space in the staircase.

According to the present invention, a staircase lift of the initially mentioned kind is provided, wherein the at least one guide rail includes internal support surfaces which may be engaged by the carrier support means.

By a staircase lift according to the invention, the objects have been achieved. By positioning the drive mechanism including the guide and carrier members inside the guide rail, a smooth exterior surface of the guide rail is maintained. The problem with the collection and deposit of dirt on the guide rail banister is eliminated. The guide rail may be designed with smooth exterior surface which is not engaged by carrier members and the like. This means that the guide rail may be provided with a surface coating or treatment chosen in order to fulfilling the requirements concerning its secondary function as a banister in the staircase.

In a preferred embodiment of the invention, the drive means comprises a first and second set of guide members pivotally arranged one behind the other on each side of the pinion drive wheel in the frame.

A staircase lift according to the invention is suitable for installation in a staircase with variable slope and bends, such as a staircase with one or more intermediate plateaux comprising a discrete guide rail with curved portions. In a staircase lift according to the invention, a compact drive means, i.e. with a vertically oriented pinion, is provided which ensures that the pinion is kept centred in the rack in the guide rail and that the moveable frame is provided with sufficient stability also when entering into a bent portion, running in the bent portion and exiting the bent portion. Hereby, a satisfactory solution is provided making a side rail guided staircase lift suitable for running along a curved track in a stabile and smooth manner while also offering a comfortable and smooth ride in a dignifying way for the disabled persons using the lift.

Preferably, the carrier support means include at least one carrier member arranged substantially above the pinion drive wheel in a traction plane and with an axis of rotation which is substantially perpendicular to the direction of travel, and wherein each of the first and second set of guiding means include an essentially vertically arranged carrier member and a top and bottom guide member having a rotary axis substantially perpendicular to that of the carrier member. Hereby, the vertical rotation axis of the carrier frame, when running along a bent portion of the guide rail, is well determined and it is ensured that the vertical rotation axis coincides with the radial axis of symmetry of the tooth or teeth of the pinion meshed with the rack.

Preferably, the pivotally arranged first and second guiding means each include a movement control lever with a first end where at least one set of idle rollers is mounted, a second end at which point the first and second movement control levers are joined to each other by a universal joint, said universal joint being substantially in the traction plane. Hereby, a compact centring and stabilising system is provided.

Moreover, the movement control levers are preferably pivotally mounted to the carrier frame at an equal distance from the universal joint on each side thereof. Hereby, the geometry of the movement control is similar irrespective of the direction of movement.

In the first embodiment, the guide rail has a generally reverse U-shape comprising a lower rail opening beside the rack of the guide rail. Moreover, the guide rail in its internal cavity is provided with at least one support surface essentially perpendicular to the traction plane for receiving the carrier members and a number of substantially vertical support surfaces for receiving engagement with the guide members.

Hereby, the movement control levers, as they are provided with a fork-like or T-like shape, are particularly compact. The carrier member positions the carrier frame relative to the horizontal support surface inside the cavity of the guide rail. The guide members ensure an accurate position of the fame by engaging the vertical support surfaces inside the rail whereby a particularly firm locking grip inside the guide rail is established preventing the carrier frame from pivoting. The upper and lower rollers co-operate to constrain the movement of the frame to movements in the directions along the guide rail.

Preferably, the teeth of the pinion wheel are substantially circular in the cross-section and the rack of the guide rail displays a row of correspondingly shaped circular holes. Hereby, the pinion is allowed to rotate whilst being intermeshed with the toothed rack. This results in a staircase lift that can run smoothly along tight bends, i.e. guide rails with a large curvature. Accordingly, at least one section of the guide rail may be curved in one or more planes.

In a first embodiment, the carrier member and/or the guiding members are made up by slide shoes, sliding on the internal support surfaces of the guide rail. Alternatively, the guide rollers are provided as guiding members. Since the guiding members are to provide guidance of the carrier frame by engaging associated surfaces on the guide rail, which are internal surfaces, the use of sliding members, such as slide shoes these internal support surfaces may be swept clean as the guiding member is sliding across the surface. Moreover, the sliding shoes may be made up by or at least provided with a surface layer of low-friction material, such as Teflon or the like.

A staircase lift according to the invention may further include a supporting guide rail mounted parallel to the first guide rail for assisting the first guide rail in carrying the load and stabilising the load-carrying frame.

In a first embodiment of the invention, the carrier frame is provided with a platform adapted to accommodate a wheelchair. In this embodiment, the handicapped person may place the wheelchair on the platform, either by himself or with the assistance of an assistant, and operate the lift for being transported up or down the stairs. In a second embodiment, the carrier frame is provided with a foldable seat for aiding disabled persons or weakened persons otherwise not able to climb the stairs.

The staircase lift is preferably provided with the required control and operating system as well as an emergency safety lock of the carrier frame to the rack. In this way, it is ensured that the frame will be held still, even if both the driving means and the carrying means collapse.

In another aspect of the invention, a guide rail is provided including a generally reverse U-shape comprising a bottom rail opening beside a groove for receiving a rack for cooperating with a pinion drive wheel, and wherein the guide rail in its internal cavity is provided with at least two support surfaces having an orientation different from, preferably substantially perpendicular to the traction plane for receiving one or more carrier members and a number of substantially vertical support surfaces for receiving engagement with a number of guide members. Hereby, the carrier support means may be suspended in the guide rail and being retained therein since the two support surfaces absorb the moment of the slidable connection between the guide rail and the carrier frame.

In the preferred embodiment, the guide rail is provided with side mounting means. Hereby, the guide rail is simple to use as a banister.

In a preferred embodiment of the invention, the guide rail is provided with an upper guide member support surface facing towards the side mounting means and a second lower guide member support surface facing away from the side mounting means, and wherein the lateral distance between the side mounting means and the carrier member support surface is smaller than the distance between the side mounting means and the lower guide member support surface which again is smaller than the distance between the side mounting means and the upper guide member support surface. Hereby, the carrier guide members are shiftably arranged inside the cavity and are retained therein due to this geometry of the cavity.

The guide rail may preferably be provided with one or more power conductor rails inside the cavity of the profile and the carrier frame is accordingly provided with contact members, such as contact brushes, contact carbons or the like. Hereby, a compact power supply to the electric drive on the carrier frame is provided, which is also elegant from a design perspective as the power supply may be completely hidden inside the guide rail profile. The conductor rails may not only be used for main power supply but additional conductor rails may be provided inside the cavity of the guide rail for power supply to and electronic transmission to and from a control panel on the carrier frame, which may be operated by the user, i.e. the person on the lift.

The guide rail is preferably made of an extruded aluminium profile. By using an aluminium extrusion process, a profile having a quite complex but still accurate internal geometry may be obtained. Another advantage of using an aluminium profile and the internal drive system is that the aluminium profile may be anodised or in other ways coated or provided with a surface treatment Such surface treatment could be a protective and/or decorative coating or treatment, e.g. a colouring of the outside of the guide rail so that the guide rail which also functions as a banister may be provided in a desired colour.

The invention also relates to a carrier frame with an internal drive system for use in a guide rail, and a guide rail for this internal drive system.

In the following, the invention is described in detail with reference to the drawings, in which.

Figure 1:
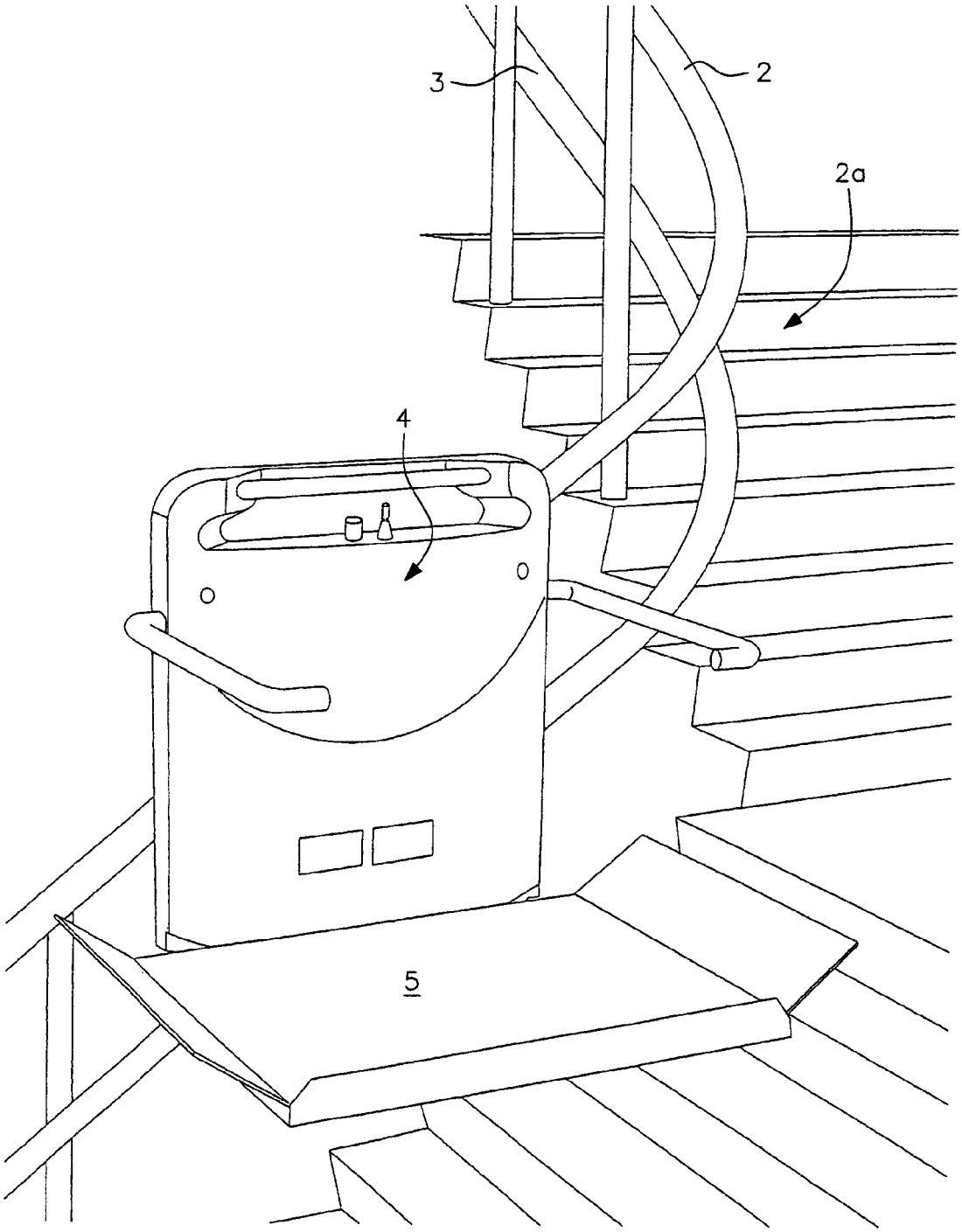
FIG. 1 is a perspective view of a staircase with a staircase lift of the platform lift type according to the invention.
Figure 2:
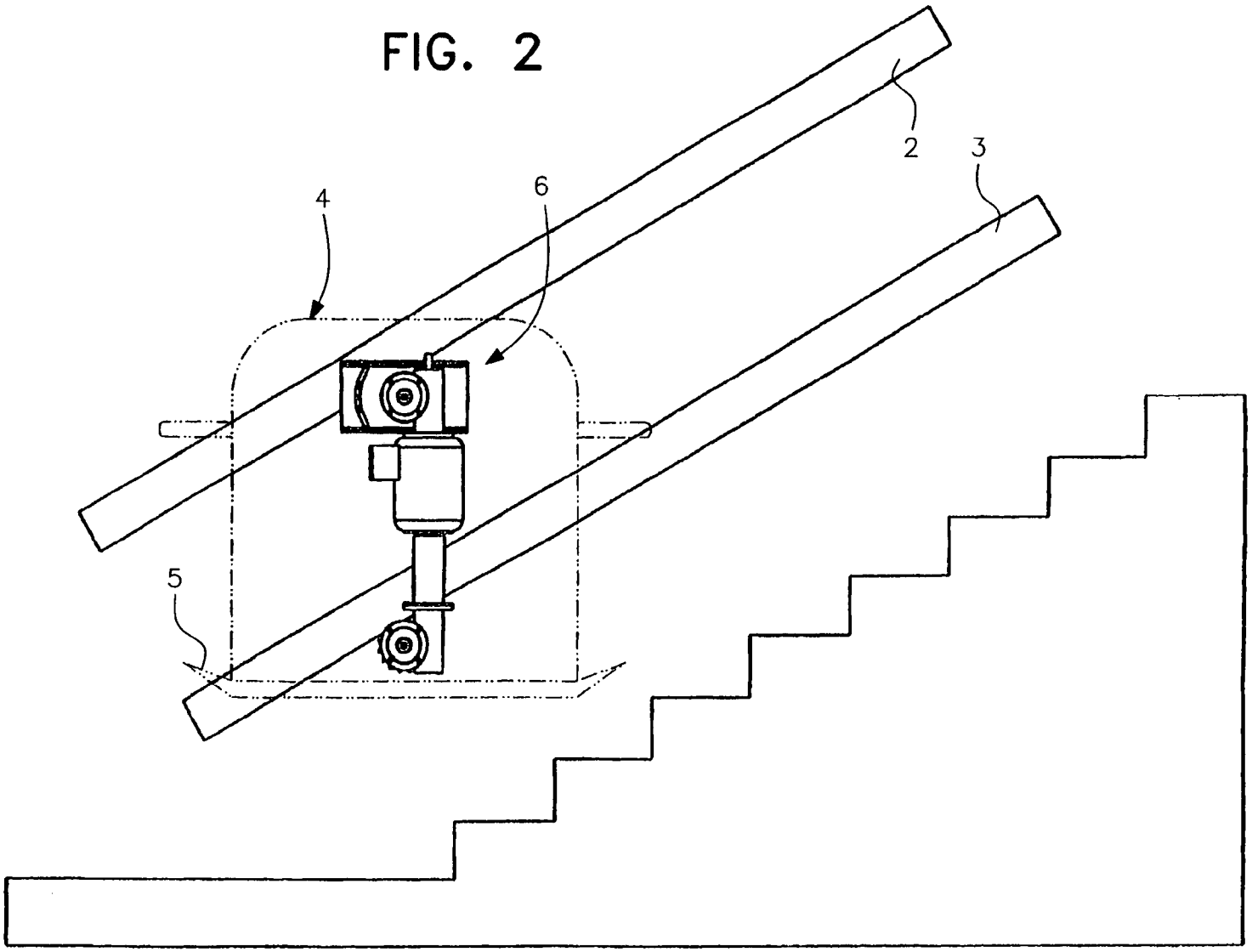
FIG. 2 is a side view of a staircase lift according to the invention.

In FIGS. 1 and 2, a staircase with a staircase lift is shown. The staircase lift is mounted on the side of the stairway, on a sidewall or a separate frame structure. The staircase lift includes a fixed part and a moveable part. The fixed part comprises a first guide rail 2 and a second guide rail 3. The two guide rails 2, 3 are mounted in parallel with one above the other on the side. The guide rails 2, 3, or at least the first guide rail 2, is/are made of a profile which functions as a banister for the stairway. As shown in the FIGS. 1 and 2, the guide rails 2, 3 follow the staircase as it changes direction. This results in a bent or curved portion 2*a* of the guide rail 2, 3. This curvature may be a result of a change in slope of the staircase and/or a change in direction, i.e. the curvature may be in a horizontal or a vertical direction or both The first guide rail 2, i.e. the top one, is provided with a rack for a geared engagement with driving means 6 of a moveable carrier frame 4 for displacing the carrier frame 4 along the guide rails 2, 3. The second guide rail 3 functions as a support for the moveable frame 4 displaced along the guide rails 2, 3. Additionally or as an alternative to the lower rail, the carrier frame 4 may be provided with stabilising means for keeping the frame 4 in a vertical position and the platform 5 in a horizontal orientation.

As shown in FIG. 2, the driving means 6 of the carrier frame 4 may comprise a motor 63 driving the pinions 7 through a top gear box 61 and a lower gear box 62 associated with the first and second guide rail 2, 3, respectively. The motor is driving the gear boxes 61, 62 through a coupling section 62. The gear boxes 61, 62 which are provided with identical transmission ration, are preferably driven by the same drive axis 64 so as to ensure that the lift is not tilted during a run. On the top end of the top gear box 61, the common drive axis 64 may extend beyond the gearbox housing where it may be provided with a manually drivable emergency wheel.

The moveable frame 4 includes a platform 5 for accommodating a disabled person in a wheelchair. Alternatively, or in addition to the platform 5, a foldable seat 5I may be provided for an assistant to the person in the wheelchair or for transporting an elderly or otherwise weakened person up or down the staircase, see FIG. 13.

Figure 3:
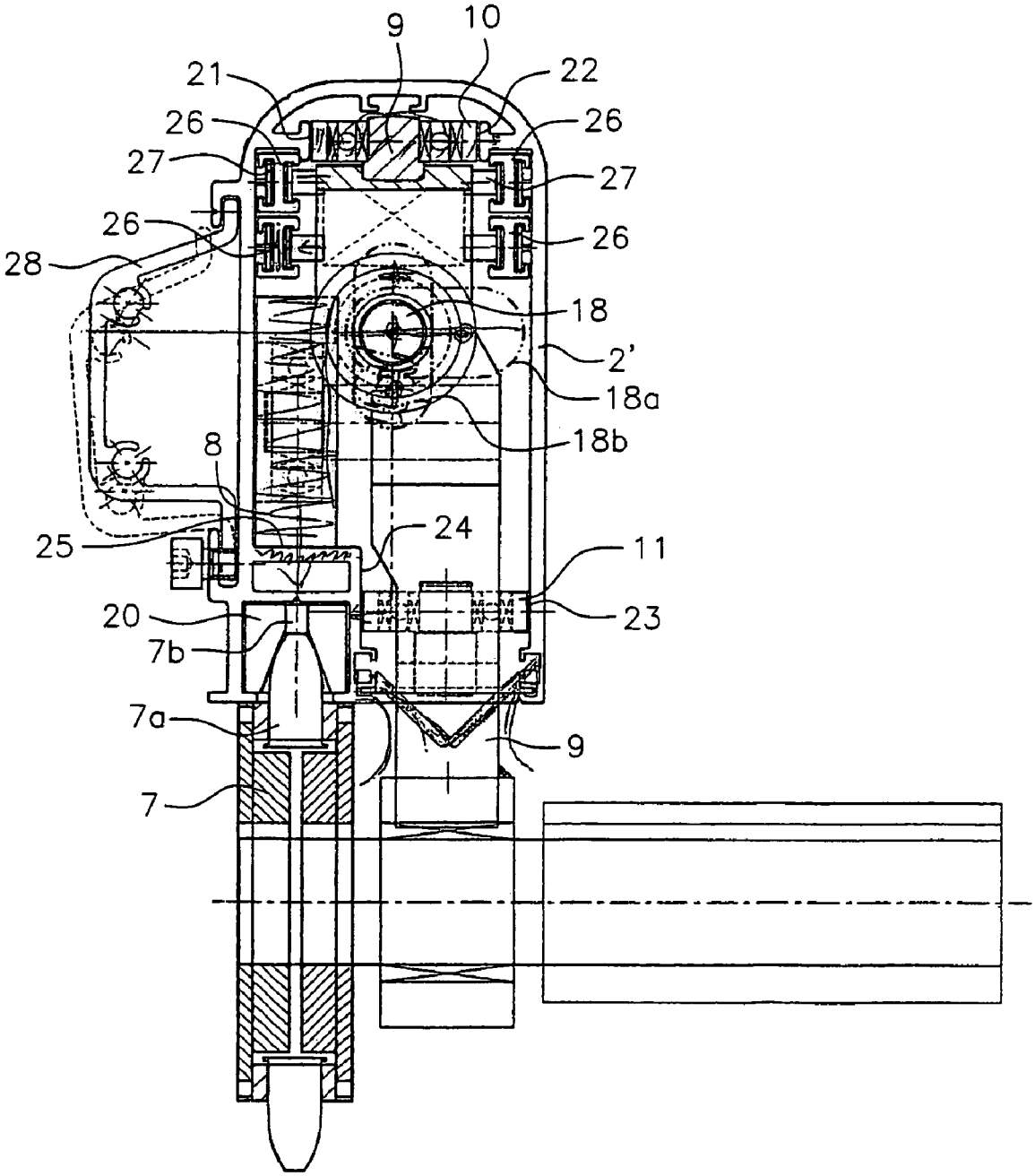
FIG. 3 is a cross-section detailed front view of a guide rail with a carrier frame according to a first embodiment of the invention.

FIG. 3 a first embodiment of the invention is shown. In FIG. 3 is shown a cross-section of the guide rail 2' having a sub-frame 9 of the carrier frame 4 provided therein. A pinion wheel 7 engages a rack 20 provided on the lowermost section of the guide rail 2'. The pinion wheel 7 is provided with teeth 7*a* shaped in the geometrically correct curved form in the radial direction of the pinion 7, but provided with a circular cross-section. Correspondingly, the rack 20 is formed in a strip of material, preferably nylon or similar polymeric material, extending along the underside of the guide rail with a row of circular holes 7*b*. The pinion 7 is preferably made of steel. Since the guide rail 2' is intended for use as a banister, the persons using the banister of the staircase might come into contact with the rack as they support themselves by means of the banister. By using a polymer-based material for the rack, the necessity for lubrication of the drive system is avoided which is advantageous as this, in turn, means that no grease or oil is deposited or present on the guide rail rack.

Figure 4:
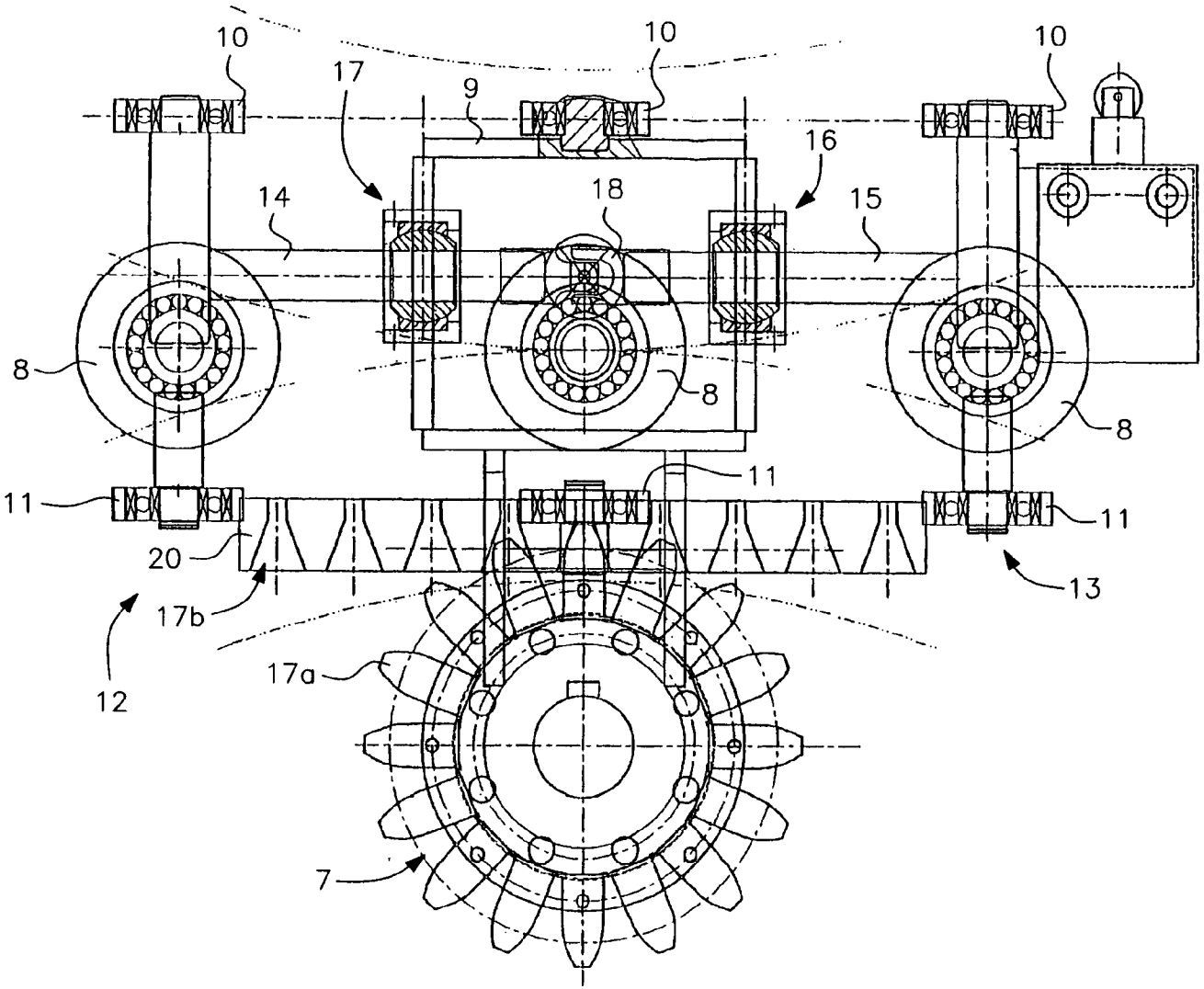
FIG. 4 is a detailed side view of the drive and guiding system according to a first embodiment of the invention in a position when the lift is running in a straight line.
Figure 5:
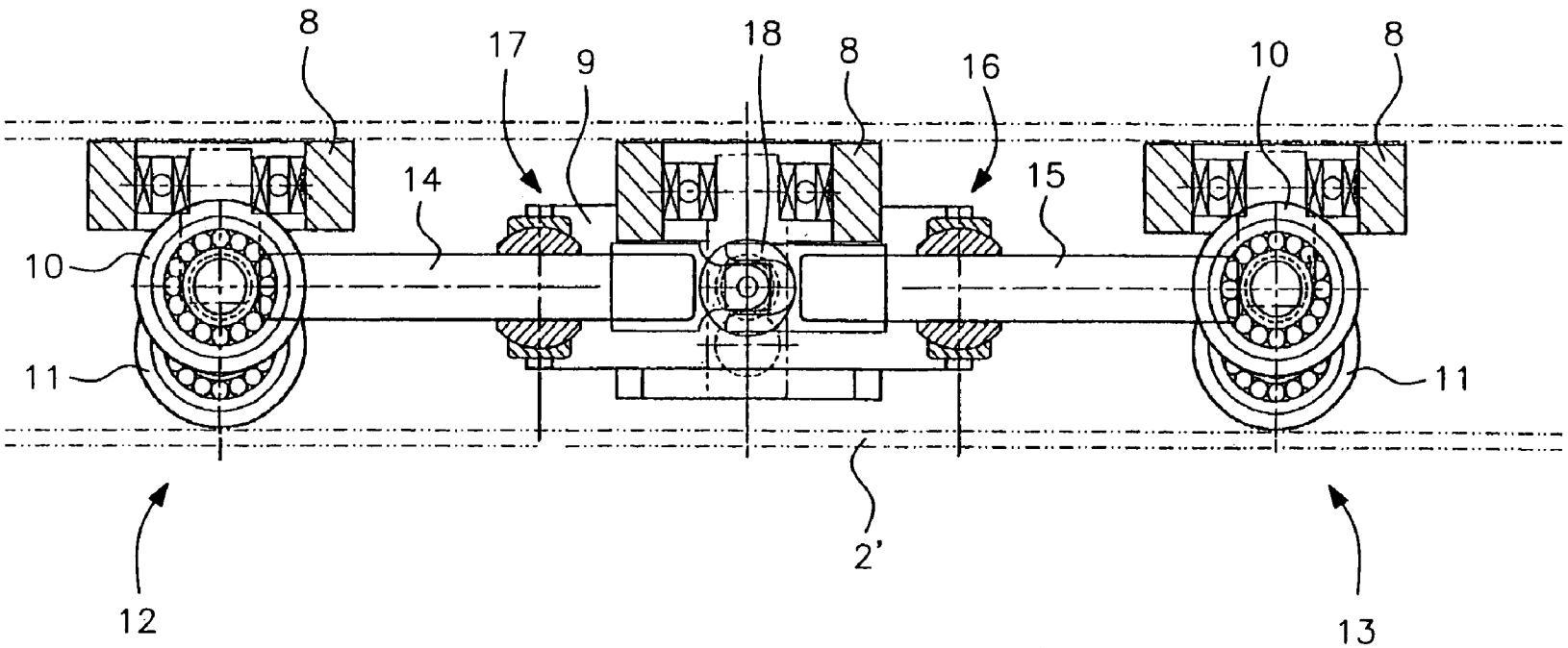
FIG. 5 is a top view of FIG. 4.

In FIGS. 4 and 5, details of the drive means are shown. The moveable frame 4 is driven along the guide rail 2 by the rack and pinion type drive, where the frame 4 is self-propelled as the pinion 7 is driven by an electric motor (not shown) powered by a rechargeable battery package (also not shown).

As shown in the cross-section of the guide rail 2' in FIG. 3, the pinion 7 engages the rack 20 on the underside of the guide rail 2'. The guide rail 2' is a hollow profile, preferably an aluminium profile provided with internal support surfaces 21, 22, 23, 24, 25 inside its cavity. On the sub-frame 9, a carrier member 8 and a top guide member 10 and a lower guide member 11 are provided. In the cavity of the guide rail 2', power supply rails 26 may preferably be provided cooperating with brushes 27 or similar sliding electrical connection means for providing power supply to the electric drive motor on the carrier frame 4.

Inside the guide rail 2', a carder member 8 is positioned to engage a support surface 25 immediately above the rack 20 and the pinion 7. The carrier member 8 rest on the internal support surface 25 of the cavity of the guide rail 2' and carry the weight of the frame and its load—possibly together with co-operating carrier members engaging the lower second guide rail 3 and carrier members on the guiding means 12, 13.

The pinion wheel 7 and the carrier member 8 are accommodated in a sub-frame 9 to which the rest of the moveable frame 4 is pivotally mounted.

First and second sets of guiding means 12, 13, respectively, are arranged on each side—seen in the direction of travel—of the pinion wheel 7 and the carrier member 8 arranged on the sub-frame 9 immediately above the pinion wheel 7 engaging the inside support surface 25. In the same plane as the pinion 7 and the carrier member 8 a top and a lower guide member 10, 11 are arranged inside the cavity, so that these guide members 10, 11 engages the vertically orientated support surfaces 21, 22 and 23, 24, respectively. The guiding means 12, 13 each include top and bottom guide members 10, 11, which are mounted on movement control levers 14 and 15 with a rotary plane generally perpendicular to the plane in which the frame moves. Each of the movement control levers 14 and 15 are fork-like or T-like in shape and carry the top guide members 10 and the lower guide member 11 on each of the fork-fingers. The levers 14, 15 are joined together by a universal joint 18 positioned substantially in the central plane of the set of carrier member 8 and the pinion 7. The levers 14 and 15 are pivotally mounted to the sub-frame in swivel joint bearings 16 and 17, respectively. The levers are provided with a certain length so that the guide members 10, 11 of the first movement lever 15 and the guiding members 10, 11 of the second lever 14 are disposed at a suitable distance from the carrier members 8 and the pinion 7 arranged in the middle of the drive means 6. The guiding means 12, 13 also include a carrier member 8 positioned between the top and lower guide members 10, 11 in a similar arrangement as the drive means 6. These carrier members 8 of the guiding means 12, 13 also engage the generally horizontally provided internal support surface 24.

In the first embodiment, the guide members 10, 11 and the carrier members 8 are roller members which roll on the respective internal support surfaces. However, in a second embodiment it is realised that slide members may also be utilised instead of or in combination with the rollers. In the FIGS. 8 to 12, a second embodiment using slide shoes as the carrier member 8 and the guide members 10, 11 is shown.

Figure 6:
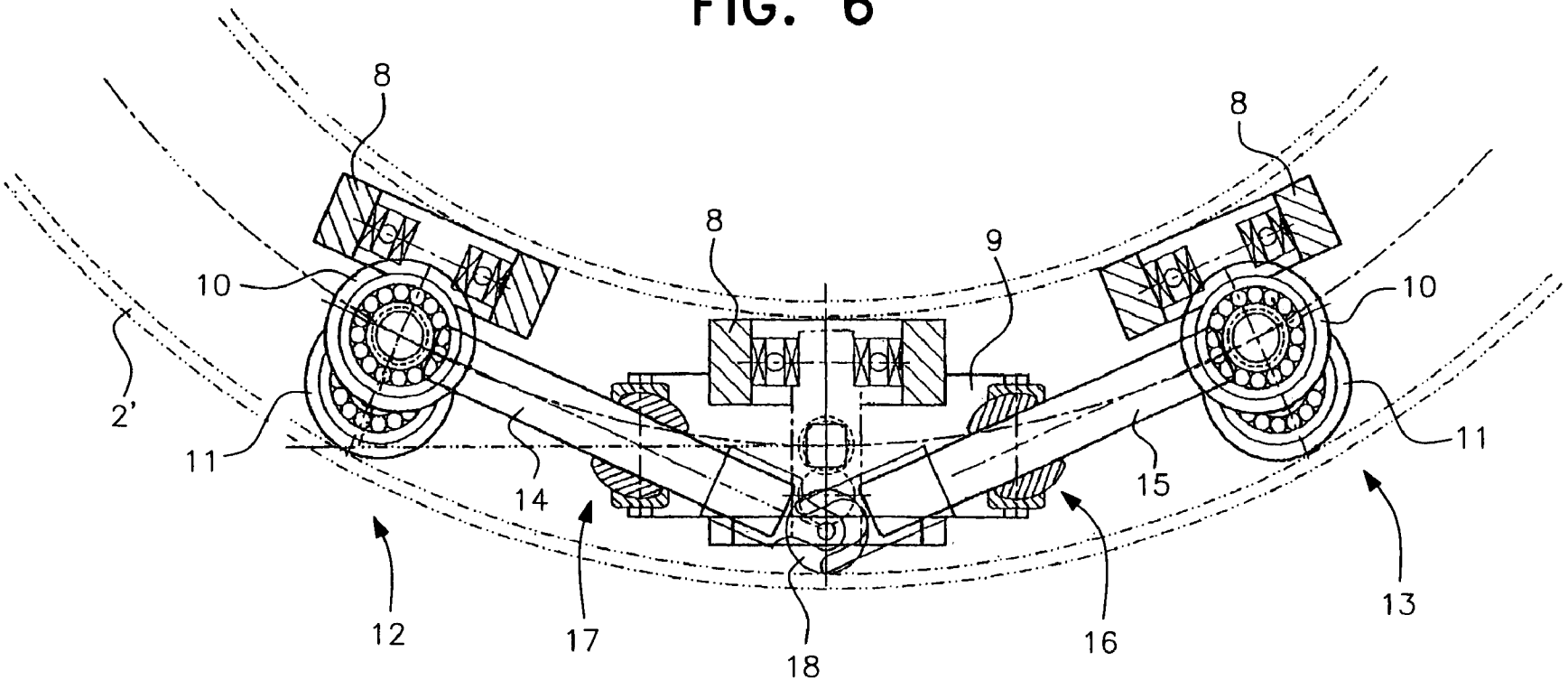
FIG. 6 is a detailed side view of the drive and guiding system according to a first embodiment of the invention in a position when the lift is running in a horizontally curved portion.

As can be seen in FIG. 6, the movement control levers 14 and 15 are bent out of the centring plane and mounted to the sub-frame 9 in a plane parallel to the centring plane at a certain distance between the two parallel planes. In this plane, the universal joint 18 is also disposed.

In this configuration, the first set of guide members 10, 11, the carrier members and the driving pinion wheel 7 and the second set of guide members 12, 13 are linked to each other in such a way that the sub-frame, and thereby the pinion and the set of carrier members 8, is automatically placed with an inclination corresponding to the tangential orientation of the section of the track in which it is present due to the linkage between the sets of guide members 10, 11; 12, 13 in front of and behind the drive pinion 7.

Figure 7:
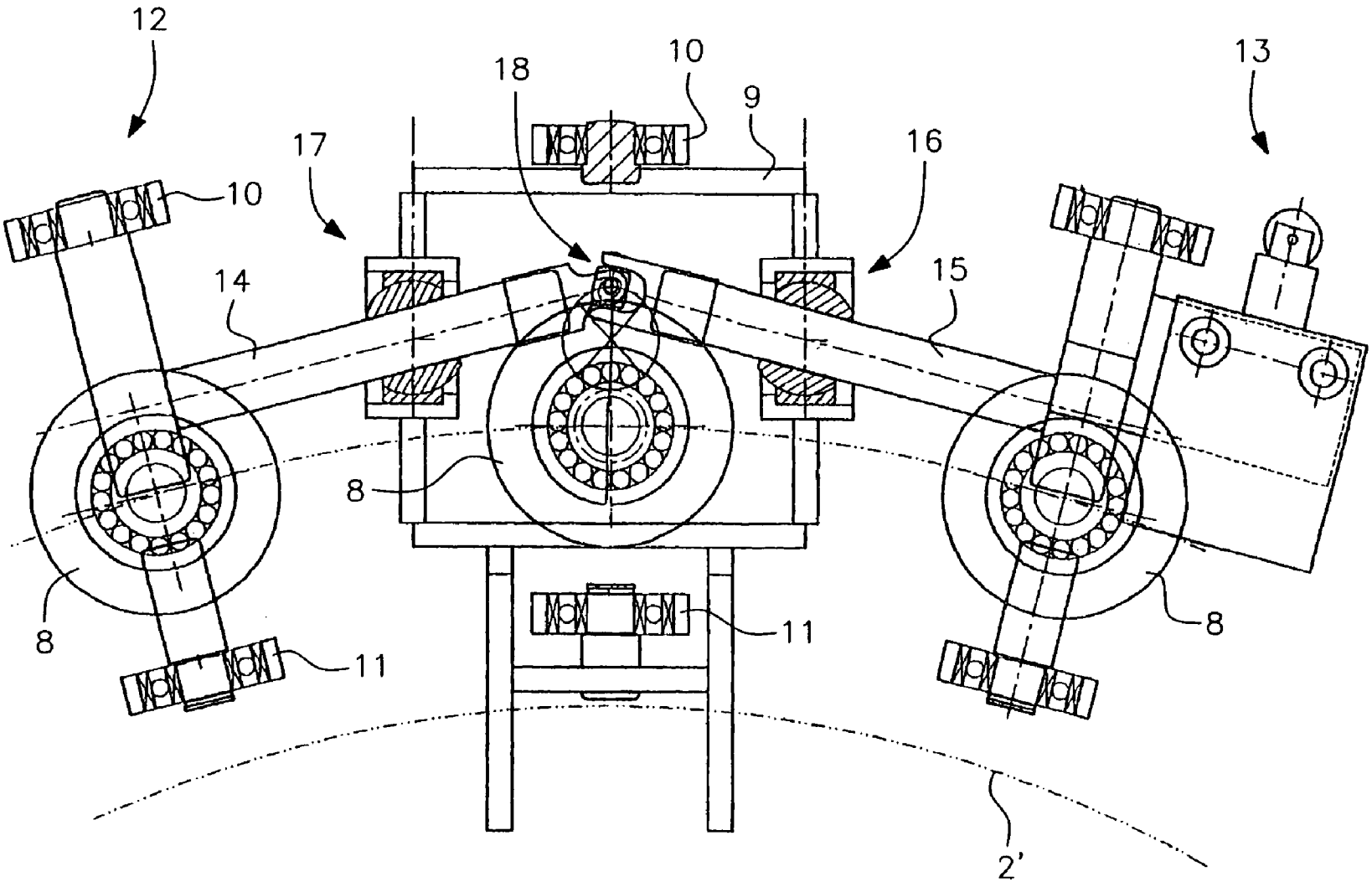
FIG. 7 is a detailed side view of the drive and guiding system according to a first embodiment of the invention in a position when the lift is running in a vertically curved portion.

In FIG. 7, a drive system according to the invention is shown in action. In this situation, the guide rail 2' is bent, e.g. due to a change in slope of the staircase. The first set of guide members 10, 11 is lifted upwards, causing the universal joint 18 downwards due to the movement control lever 15 which is pivotally mounted in the swivel joint 16. When the universal joint 18 is moved out of its initial position (the initial position being its "straight line" position, as shown in FIGS. 4 and 5), the second movement control lever 14 is loaded. However, since the trailing, second guiding means 12 of the second lever 14 are in contact with the guide rail 2', the second swivel joint 17, over which the second movement control lever 14 is pivotally mounted to the sub-frame 9, is forced downwards causing the entire sub-frame 9 to rotate slightly, including the carrier members 8 and the pinion wheel 7. In this way, the pinion wheel is kept in an intermeshing engagement with the rack 20 on the underside of the rail 2'.

In FIG. 6, a similar situation of movement is illustrated in relation to a turn, e.g. as the staircase lift is mounted in a swinging staircase, or the guide rail 2' follows a corner of a staircase. In this situation, the first set of rollers 10 is moved sideways towards the direction of the turn, e.g. to the left, causing the first movement control lever 15 to pivot in the swivel joint 16 and move the universal joint 18 outwards in the turn which forces the second movement control lever 14 to move the sub-frame 9 outwards due to the swivel joint connection of the second movement lever 14 to the sub-frame 9. Hereby, the tooth or teeth 7*a* of the pinion 7 engaging the rack is/are kept in alignment in the rack 20, also during a change in the direction of travel of the frame.

The components of the drive means 6 are preferably mirrored so that the geometry and the physical characteristics of their movement are the same irrespective of the direction of movement of the moveable frame in the staircase lift.

In FIG. 3, the distances of movements of the universal joint 18 in the horizontal direction 18*a* and in the vertical direction 18*b* are shown, as the staircase runs through a curving or sloping section, respectively.

Micro switches or other types of distance measurement equipment (not shown) may be provided at the extreme positions of movements of the vertical direction 18*b* of the universal joint 18 in order to provide a control signal for a control system to automatically adjusting the carrier frames relative position to the sub-frame 9 as the staircase lift runs through a change in the slope. By this control system, the orientation of the carrier frame 4 is kept vertical and its platform kept accurately horizontal, so that the load on the platform is prevented from falling off.

Figure 8:
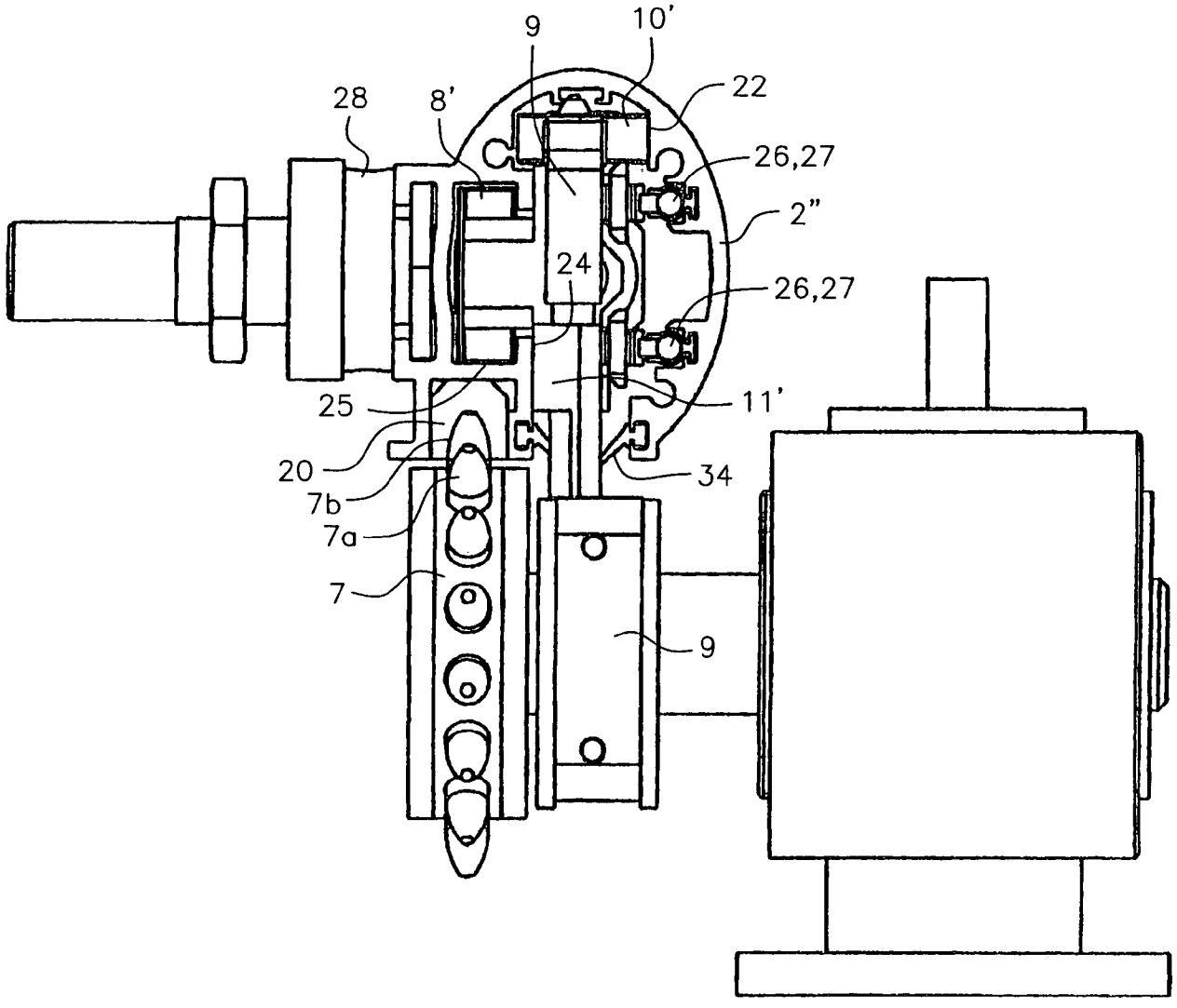
FIG. 8 is a cross-section detailed front view of a guide rail with a carrier frame according to a second embodiment of the invention.

In FIG. 8, a second embodiment of the invention is shown. This embodiment is particularly advantageous as the position of slide support surfaces 22, 24 and 25. In this embodiment, the sub-frame 9 is suspended from the guide rail 2', which is mounted by the mounting means 28. The upper slide shoe 10' engages the vertical support surface 22 and the lower slide shoe 11' engages the lower vertical support surface 24, whereas the carrier slide shoe 8' engages the horizontal support surface 25. The support surfaces 22, 24 and 25 are integrally formed on the inside cavity of the generally U-shaped guide rail 2' (see FIG. 14).

Figure 14:
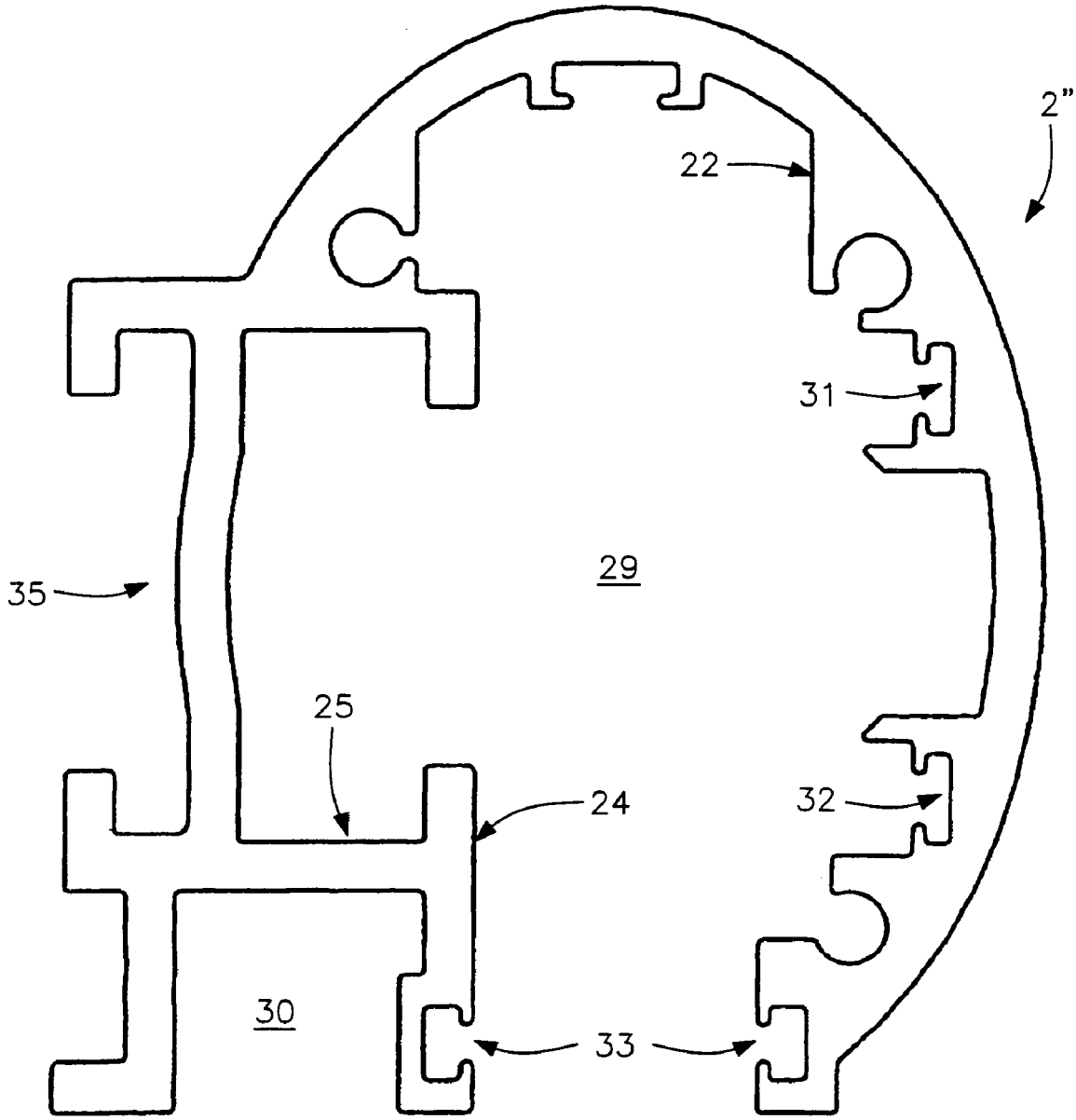
FIG. 14 is a cross-section view of a guide rail according to the second embodiment of the invention.

As shown in FIG. 14, the guide rail profile 2" provided with a cavity 29 in which the support surfaces are provided. On the outside of the profile 2", side mounting receiving means 35 are integrally provided. The outside surface is otherwise provided with a generally smooth surface making the guide rail profile 2" a proper staircase banister. In the cavity 29, the upper guide member support surface 22 is provided in the uppermost outer portion of the profile 2", whereas the lower guide member support surface 24 is provided in the lower innermost section close to the side mounting means and the profile opening 33. The horizontal carrier member support surface 25 is provided in the cavity 29 in between the lower guide support surface and the side mounting receiving means 35 which are formed on the outside of this profile wall portion. As it may be seen from FIG. 3 as well as FIG. 14, the sub-frame 9 is suspended from the guide rail 2". When the horizontal carrier member support surface 25 engages the innermost support surface 25, the lower guide member 11 is forced against the lower support surface 24 and the upper guide member 10 is brought in engagement with the upper guide support surface 22. By providing the support surfaces in these relative positions in the cavity of the profile 2", the risk of "opening" the profile by bending the outer profile wall section opposite the side mounting. The guide rail profile according to this embodiment is thus particularly advantageous for accommodating the internally arranged carrier support means for diving the staircase lift.

On the inside of the outer profile wall, the profile cavity 29 is provided with indentations 31, 32 for the accommodation of power supply rails 27 which cooperate with associated brushes or similar power connecting means 26 on the sub-frame 9. At the profile opening 33, a set of covering brushes or sealing lips 34 may be provided in order to prevent dirt from entering into the profile cavity 29. Beside the opening 33 is arranged a track 30 for accommodating the toothed rack 20, said track being integrally formed in the profile 2" just below the horizontal support surface 25.

Figure 9:
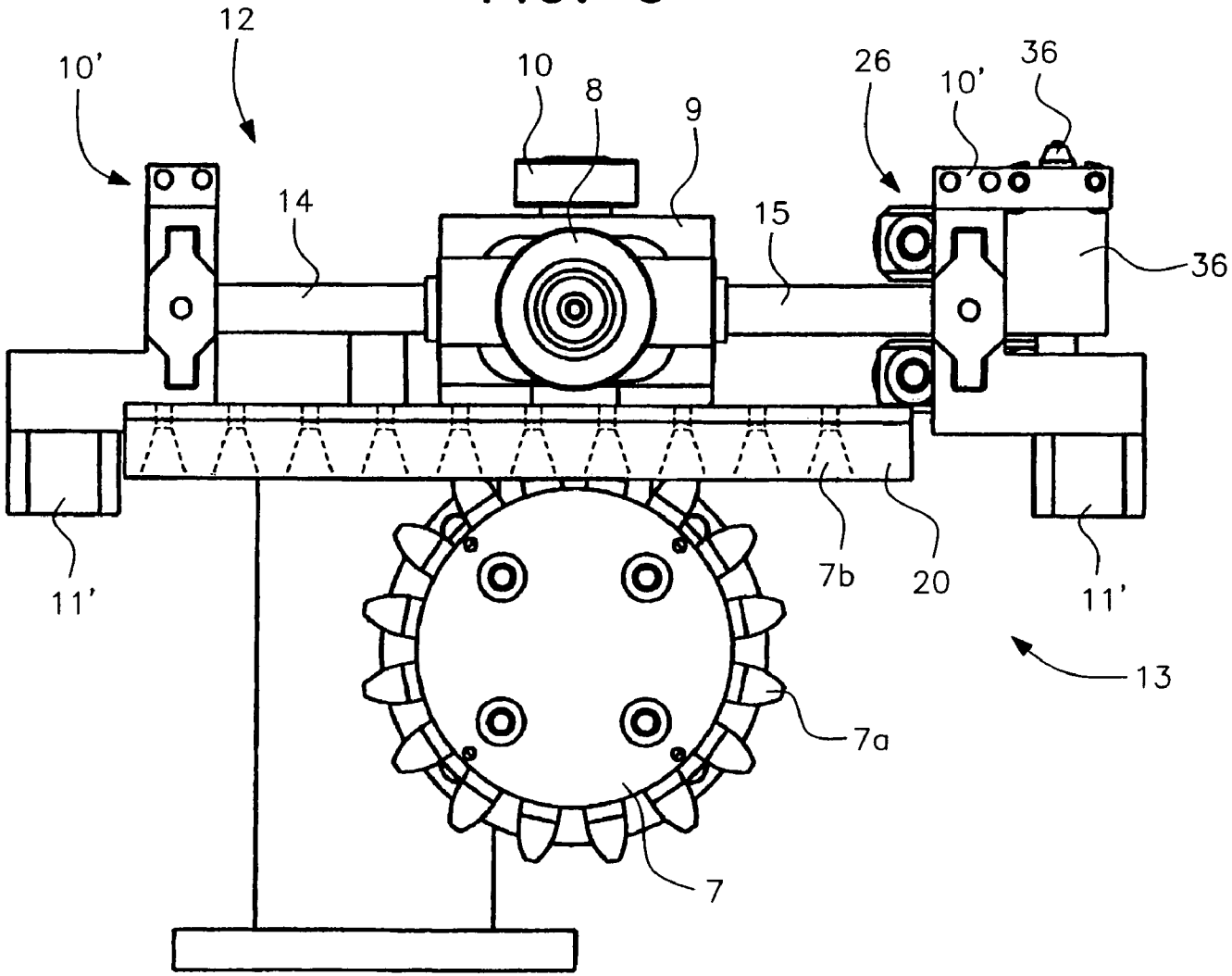
FIG. 9 is a detailed side view of the drive and guiding system according to a second embodiment of the invention in a position when the lift is running in a straight line.
Figure 10:
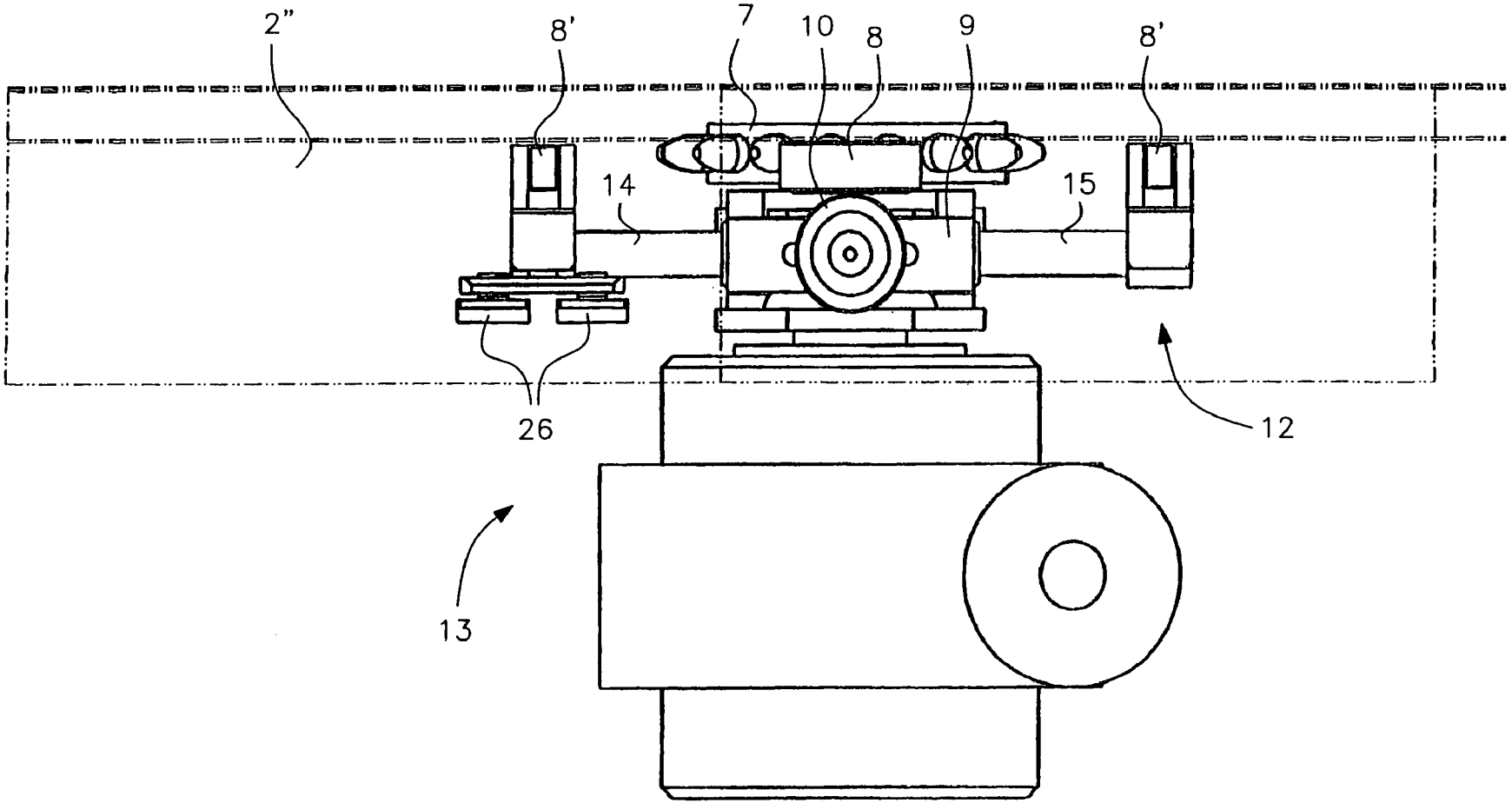
FIG. 10 is a top view of FIG. 9.

In FIGS. 9 and 10, the carrier support means according to the second embodiment of the invention is shown. The first and second guiding means 12, 13 are arranged with a cooperating functional relationship similar to the relationship described in FIGS. 4 and 5. As shown in FIG. 9 each extreme end of the guiding means 12, 13 may be provided with an end stop sensor 36. In FIG. 9, an end stop sensor 36 is shown only at the second guiding means 13. The power connecting slide means 26 may be provided at one of the guiding means 13, as shown in FIG. 9 to 12 or at both guiding means 12, 13 (not shown).

Figure 11:
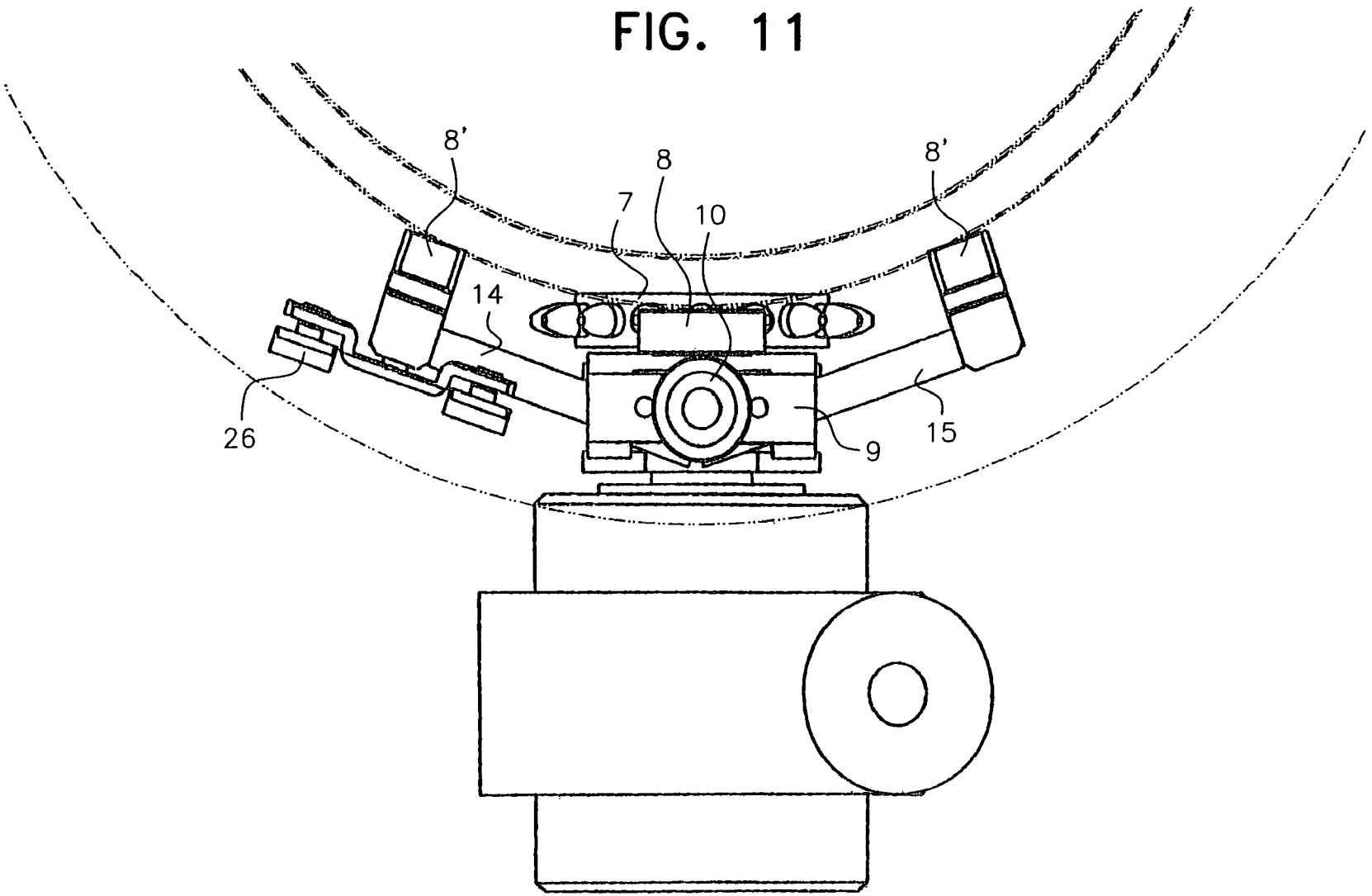
FIG. 11 is a detailed side view of the drive and guiding system according to a second embodiment of the invention in a position when the lift is running in a horizontally curved portion.
Figure 12:
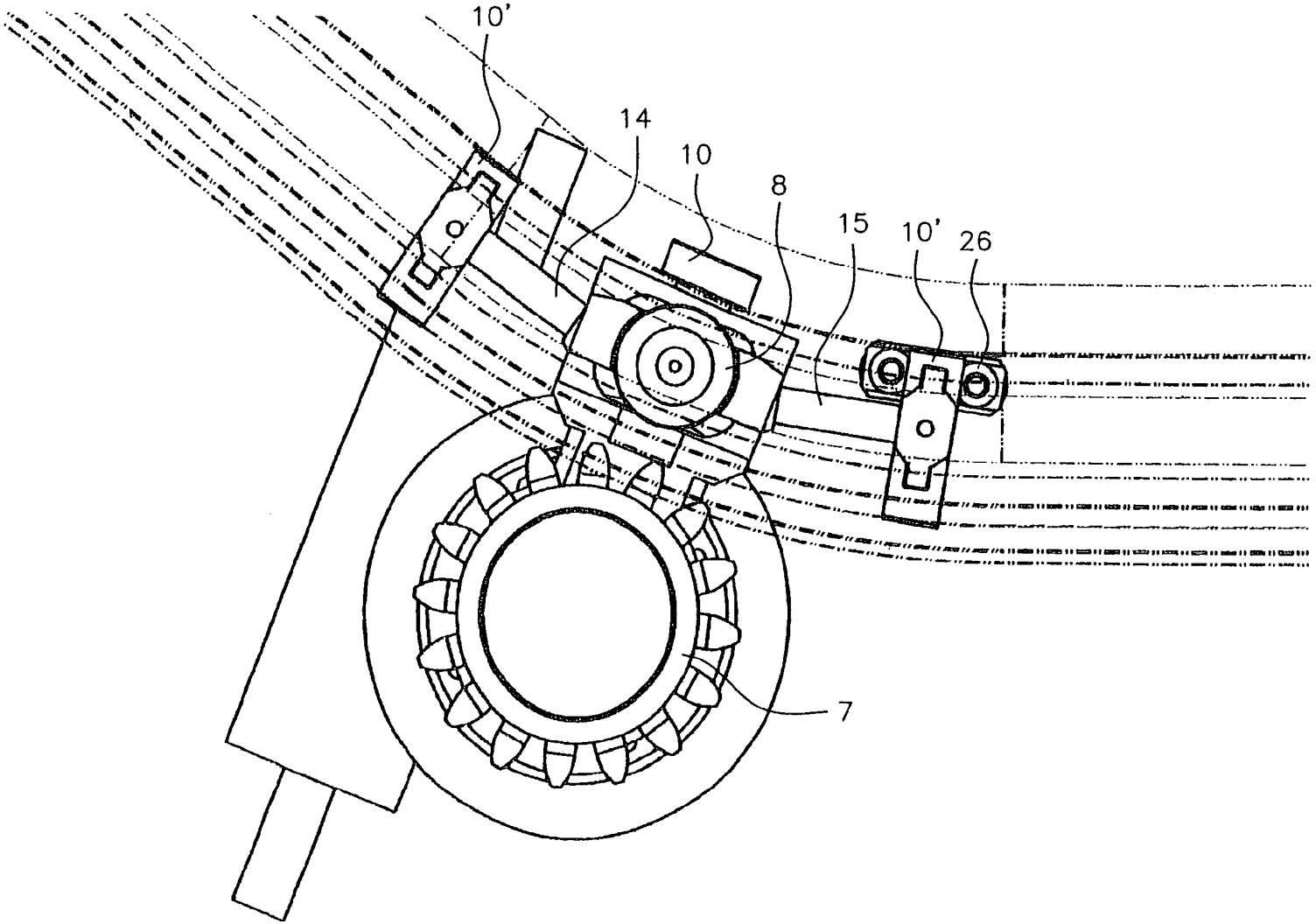
FIG. 12 is a detailed side view of the drive and guiding system according to a second embodiment of the invention in a position when the lift is running in a vertically curved portion.

FIGS. 11 and 12 show the carrier support means running through bends in either a horizontal or a vertical plane corresponding to the FIGS. 6 and 7, respectively.

Figure 13:
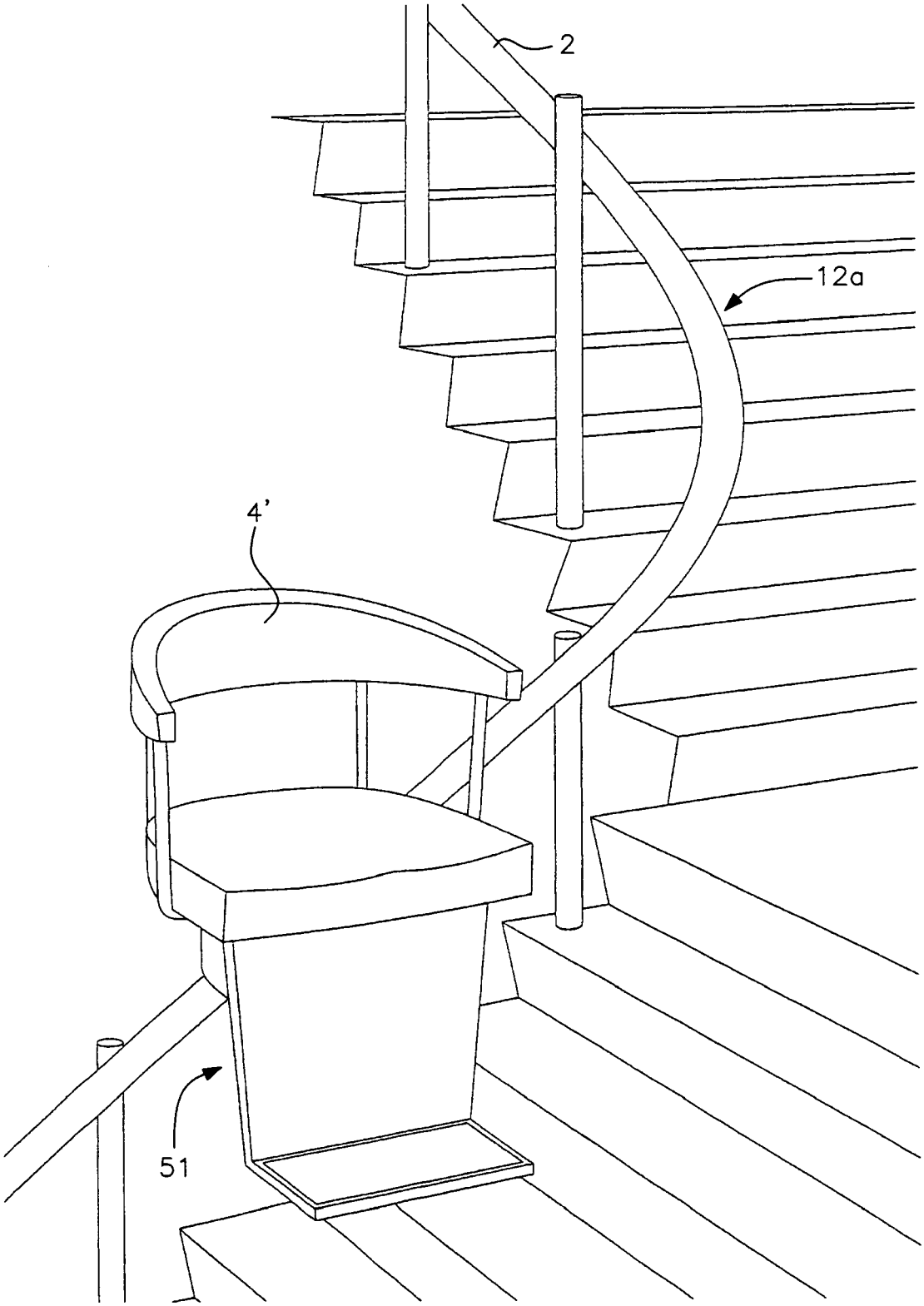
FIG. 13 is a perspective view of a staircase with a staircase lift of the seat lift type according to the invention.

In FIG. 13, another embodiment of the invention is shown, as the staircase lift according to the invention is designed as a seat type lift. According to this embodiment, only one guide rail is used. The guide support means in this embodiment are basically the same as for the platform lift, but may be slightly altered as no second guide rail is provided, e.g. additionally, the lift may be provided with vertical stabilising means ensuring the desired substantially horizontal orientation of the seat is maintained.

In the description of the invention, terms like horizontal and vertical are used for the explanation of the invention. However, it is realised by the invention that these terms should merely be understood as relative terms and that an entire drive mechanism and staircase lift according to the invention may be positioned in any direction without departing from the scope of the invention, as such solutions and other solutions making use of the general idea behind the invention are considered to be solutions equivalent to solutions according to the invention as set forth in the accompanying claims.

The invention claimed is:

1. A staircase lift for transporting a disabled person between floors, comprising at least one guide rail extending substantially parallel to a stairway, a moveable carrier frame suspended from the at least one guide rail including carrier support means, said at least one guide rail is including internal support surfaces, which are engaged by the carrier support means, said moveable carrier frame includes drive means comprising a rack and pinion drive for displacement of the carrier frame along the guide rail, in which a vertically disposed pinion drive wheel engaging a rack, which is provided on the lower side of the guide rail, the drive means is comprising a first and second guiding means pivotally arranged one behind the other on each side of the pinion drive wheel in the frame, and wherein the pivotally arranged first and second guiding means each include a movement control lever with a first end and where at least one set of guiding members are mounted, a second end at which point the first and second movement control levers are joined to each other by a universal joint, said universal joint being substantially in a traction plane which is perpendicular to the pinion.

2. A staircase lift according to claim 1, wherein the carrier support means include at least one carrier member arranged above the pinion drive wheel substantially in the traction plane and with an axis of rotation which is substantially perpendicular to the direction of travel, and wherein each of the first and second guiding means include an essentially vertically arranged additional carrier member and a top and bottom guiding member.

3. A staircase lift according to claim 1, wherein the movement control levers are pivotally mounted to the carrier frame at an equal distance from the universal joint on each side thereof.

4. A staircase lift according to claim 2, wherein the guide rail has a generally reverse U-shape comprising a lower rail opening beside the rack of the guide rail, and wherein the guide rail in its internal cavity is provided with at least one support surface essentially perpendicular to the traction plane for receiving the carrier members and a number of substantially vertical support surfaces for receiving engagement with the guide members.

5. A staircase lift according to claim 1, wherein the carrier member is slide shoe member.

6. A staircase lift according to claim 1, wherein the carrier member is a roller.

7. A staircase lift according to claim 1, wherein the guiding members are slide shoe members.

8. A staircase lift according to claim 1, wherein the guide members are guide rollers.

9. A staircase lift according to claim 1, wherein the teeth of the pinion wheel are substantially circular in the cross-section and the rack of the guide rail displays a row of correspondingly shaped circular holes.

10. A staircase lift according to claim 1, wherein at least one section of the guide rail is curved in one or more planes.

11. A staircase lift according to claim 1, wherein the staircase lift further includes a supporting guide rail mounted parallelly to the first guide rail.

12. A staircase lift according to claim 1, wherein the carrier frame is provided with a platform adapted to accommodate a wheelchair.

13. A staircase lift according to claim 1, wherein the carrier frame is provided with a foldable seat.

14. A staircase lift according to claim 1, wherein the guide rail is provided with at least one power conductor rail and the carrier frame is provided with associated contact members for providing power to an electrical motor of the drive means.

15. A staircase lift according to claim 14, wherein one or more further conductor rails and associated contact members are arranged for a lift control panel provided on the carrier frame.

* * * * *